US007121520B2

(12) United States Patent
Khoo

(10) Patent No.: US 7,121,520 B2
(45) Date of Patent: Oct. 17, 2006

(54) PRE-CAST CONCRETE PANELS FOR CONSTRUCTION OF A BUILDING

(75) Inventor: Tian Khoo, Taman Desa (MY)

(73) Assignee: O-Stable Panel Sdn. Bhd., Kuala Lumpur (MY)

( * ) Notice: Subject to any disclaimer, the term of this patent is extended or adjusted under 35 U.S.C. 154(b) by 0 days.

(21) Appl. No.: 09/874,938

(22) Filed: Jun. 4, 2001

(65) Prior Publication Data

US 2002/0000506 A1 Jan. 3, 2002

Related U.S. Application Data

(63) Continuation-in-part of application No. 09/011,420, filed on Apr. 30, 1998, now Pat. No. 6,223,480.

(30) Foreign Application Priority Data

May 11, 2001 (MY) ..... PI 2001 2228

(51) Int. Cl.
*E28B 7/02* (2006.01)
*E04G 11/00* (2006.01)

(52) U.S. Cl. ..... 249/157; 249/158; 249/162; 249/168

(58) Field of Classification Search ..... 249/157, 249/158, 160, 162, 168
See application file for complete search history.

(56) References Cited

U.S. PATENT DOCUMENTS

| | | | | |
|---|---|---|---|---|
| 799,493 | A * | 9/1905 | Pfeiffer | 249/158 |
| 896,330 | A * | 8/1908 | Scheelky | 249/93 |
| 963,368 | A | 7/1910 | Hall | |
| 1,072,293 | A | 9/1913 | Zeimet | |
| 1,530,489 | A * | 3/1925 | Gaston | 249/157 |
| 1,726,169 | A | 8/1929 | Winter | |
| 1,924,801 | A | 8/1933 | Olmstead | |
| 1,982,217 | A | 11/1934 | Luehrs | |
| 2,043,697 | A | 6/1936 | Deichmann | |
| 2,218,694 | A | 10/1940 | Ergoroff | |
| 2,708,359 | A | 5/1955 | Henry | |
| 2,940,295 | A * | 6/1960 | Post | 52/204.1 |
| 3,035,375 | A | 5/1962 | Williams | |
| 3,535,841 | A | 10/1970 | Lorenz et al. | |
| 3,604,169 | A | 9/1971 | Smith | |
| 3,645,056 | A | 2/1972 | Gerola | |

(Continued)

FOREIGN PATENT DOCUMENTS

| | | |
|---|---|---|
| AU | 3443/51 | 8/1951 |

(Continued)

OTHER PUBLICATIONS

Computer translation of JP 07-229240.*

*Primary Examiner*—Donald Heckenberg
(74) *Attorney, Agent, or Firm*—The Harris Firm

(57) ABSTRACT

A formwork for precast concrete panel comprises of a quadrangle panel with a base and four side panels. The formwork (10) comprises of a base (14), which is provided with an island region (20) and/or a mound region (22), a pair of parallel fixed spaced apart side panels (16) and a pair of parallel moveable side panels (18). The island region (20) and/or mound region (22) is positioned between the parallel moveable paced apart side panels (18) and wherein said parallel moveable spaced apart side panel (18) are removeably secured to the parallel fixed spaced apart side panels (16) in a tight manner in any desired distance from the center of the island (20) and/or mound (22) region.

2 Claims, 14 Drawing Sheets

U.S. PATENT DOCUMENTS

| | | | | | |
|---|---|---|---|---|---|
| 3,662,506 | A | | 5/1972 | Dillon | |
| 3,685,241 | A | | 8/1972 | Cooper | |
| 3,759,002 | A | | 9/1973 | Cornella et al. | |
| 3,821,869 | A | | 7/1974 | Morgan | |
| 3,910,000 | A | | 10/1975 | Kelsey | |
| 3,919,820 | A | | 11/1975 | Green | |
| 3,931,951 | A | | 1/1976 | Fougea | |
| 3,952,471 | A | | 4/1976 | Mooney | |
| 4,141,532 | A | | 2/1979 | Wall | |
| 4,147,009 | A | | 4/1979 | Waltry | |
| 4,159,100 | A | * | 6/1979 | Landowski | 249/99 |
| 4,398,378 | A | | 8/1983 | Heitzman | |
| 4,925,556 | A | | 5/1990 | Gaudin et al. | |
| 4,942,707 | A | | 7/1990 | Huettemann | |
| 5,332,191 | A | | 7/1994 | Nolan | |
| 5,372,349 | A | * | 12/1994 | Elmore | 249/112 |
| 5,489,164 | A | | 2/1996 | Tusch et al. | |
| 5,548,937 | A | | 8/1996 | Shimonohara | |
| 5,758,461 | A | | 6/1998 | McManus | |
| 5,761,862 | A | | 6/1998 | Hendershot et al. | |

FOREIGN PATENT DOCUMENTS

| | | |
|---|---|---|
| AU | 27062/67 | 3/1967 |
| CH | 447543 | 3/1968 |
| DE | 2430635 | 1/1976 |
| DE | 2728911 | 2/1978 |
| DE | 3038871 | 5/1982 |
| EP | 80980 | 6/1983 |
| FR | 938349 | 9/1948 |
| FR | 1006076 | 4/1952 |
| FR | 2441127 | 7/1980 |
| FR | 67923 | 4/1981 |
| FR | 2495207 | 6/1982 |
| GB | 650634 | 2/1951 |
| GB | 1402259 | 8/1975 |
| JP | 07-229240 | 8/1995 |
| WO | 94/17259 | 8/1994 |

* cited by examiner

PRE-CAST CONCRETE PANELS FOR CONSTRUCTION OF A BUILDING

FIELD OF THE INVENTION

The present invention relates to a formwork for pre-cast concrete panels used in the building industry. The present invention more particularly relates to an adjustable formwork for constructing concrete panels, which are provided with an opening or a recess portion. Most particularly the present invention relates to a portable and lightweight formwork for precast concrete panel.

BACKGROUND OF THE INVENTION

In the prior art, there have been numerous methods of constructing precast concrete structures for the purpose of building engineering structures such as houses, office buildings or other concrete structures. Columns and beams are the most common precast concrete structures constructed in a factory and later transported to the site.

The site for constructing precast concrete panels are generally located far from the construction site and therefore transporting said precast concrete structures is very costly as it requires heavy transportation. Furthermore, the high cost of transportation is one of the reasons why precast concrete structures have not gained much popularity in the field of building industry.

Normally, each section in a building consists of different size of structural panels, which have different widths, heights and thickness. Where precast concrete panel are used, preparing different moulds for each type of panel in a building can be an expensive exercise and time consuming.

U.S. Pat. No. 5,219,473 teaches a method of casting a precast beam comprising of a formwork with at least two spatially oriented upper sleeves and two spatially oriented lower sleeves and there between provided a connecting member. The length and height of the precast beam is determined by the dimension of the connecting member, which preferably is wood. There is one drawback of this invention, each time a new beam is to be casted, a new connecting member is required. This method becomes inconvenient as storage space is required to store the connecting members.

The objective of the present invention is to reduce the above mentioned drawbacks by providing a portable and light weight formwork, which is easily transported to the construction site with minimal transportation cost.

Another objective of the present invention is to provide a longitudinal channel with sufficient thickness along the edges of the precast concrete panel but reducing the thickness of the central region of the precast concrete panel.

Another objective of the present invention is that to introduce an universal formwork, wherein the same formwork can be used to cast different size of concrete panel without adding any additional formwork.

Another objective of the present invention is to introduce a precast concrete panel with aesthetic opening for the installation of window and the like

SUMMARY OF THE INVENTION

A formwork for precast concrete panel comprises of a quadrangle panel with a base and four side panels. The formwork comprises of a base which is provided with an island region and/or a mound region, a pair of parallel fixed spaced apart side panels and a pair of parallel moveable side panels. The island region and/or mound region is positioned between the parallel moveable paced apart side panels and wherein said parallel moveable spaced apart side panel are removeably secured to the parallel fixed spaced apart side panels in a tight manner in any desired distance from the center of the island and/or mound region.

The parallel moveable spaced apart side panel is slideable against the pair of parallel fixed spaced apart side panel. The parallel moveable spaced apart side panels are secured to the parallel fixed space apart side panels at pre-determined distance from the center of the mould. The parallel moveable spaced apart side panels are positionable to a pre-determined distance apart and wherein the same formwork with an island region and/or mound region is usable for constructing precast concrete panels of different pre-determined widths.

The parallel moveable spaced apart side panel includes a longitudinal ledge such that the therein-casted panel would include a longitudinal channel corresponding to the longitudinal ledge. At least one of the pair of parallel fixed spaced apart side panels includes at least one aperture to receive at least one reinforcement member. The peripheral side of the island region includes a patterned edge. The peripheral side of the mound region includes a patterned surface. The mound region optionally includes a mould of any desired impressions.

A subsidiary formwork is assembled thereon to the formwork in which the subsidiary formwork comprises of a pair of longitudinal spaced apart panels across the pair of parallel fixed spaced apart side panels. The inner sides of the longitudinal spaced apart panel form the sides of a mould and the upper surface of the concrete in the formwork forms the base of the mould, said mould is designed to receive concrete such that on setting, a projecting edge is formed. The subsidiary formwork is positionable at any point along the parallel fixed spaced apart side panels. The distance apart between each member of the said of longitudinal spaced apart panel is variable such that the casted longitudinal ledge is of variable pre-determined width. A longitudinal channel is accommodated within the subsidiary formwork such that the therein, casted projecting edge (30) includes a longitudinal channel.

DETAILED DESCRIPTION OF THE INVENTION

Figure 1:
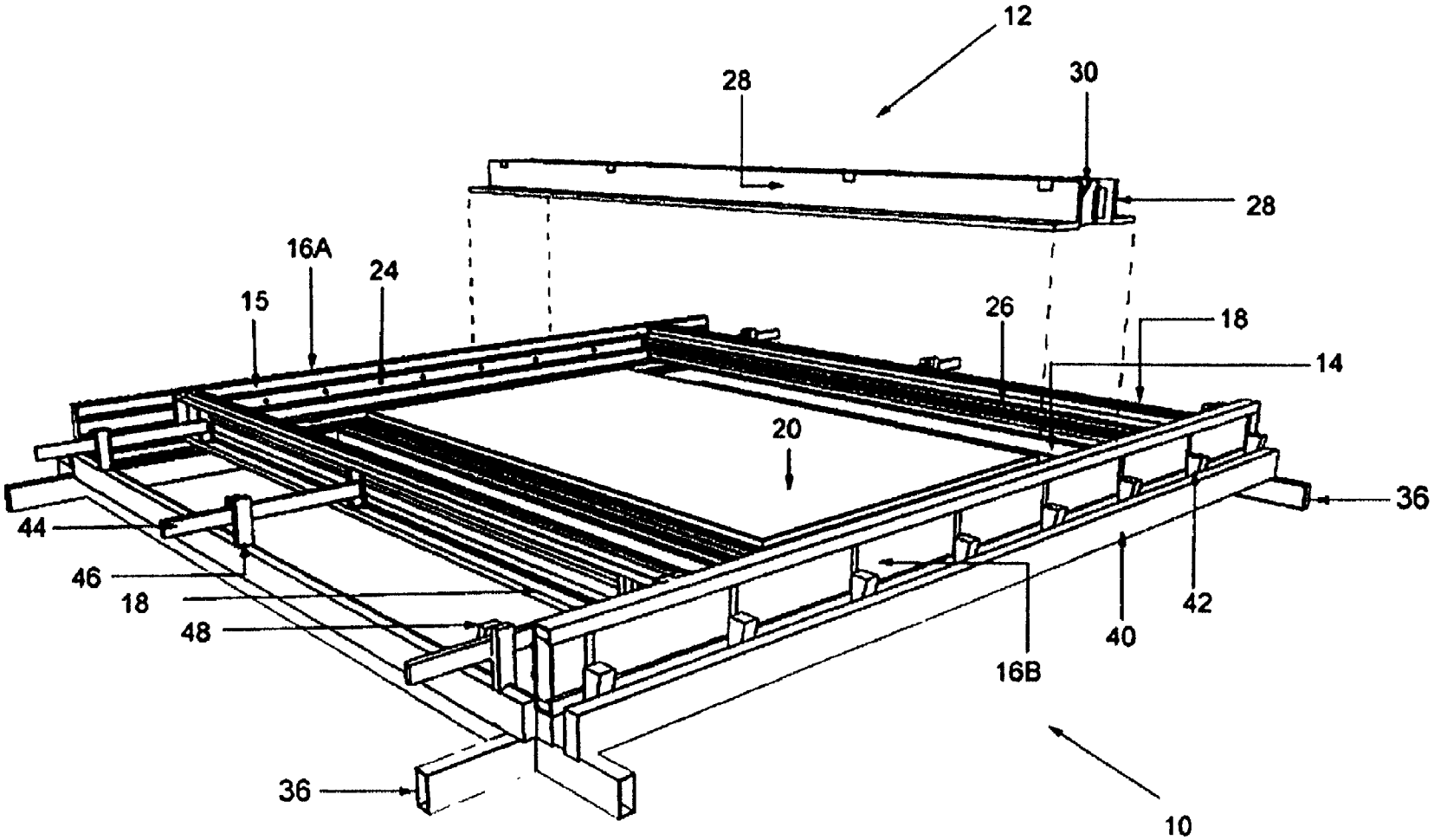
FIG. 1 is a perspective view of the present embodiment of the invention.

The present invention comprises of a main formwork (10) and optionally a subsidiary formwork (12). The main formwork (10) comprises of a preferably quadrangular shaped base (14), a pair of parallel fixed spaced apart side panels (hereinafter referred to as fixed panels) (16) and a pair of parallel slideable spaced apart side panels (hereinafter referred to as slideabe panels) (18). The base (14) is further provided with an island region (20) and/or a mound region (22) preferably between the slideable panels (18), (FIG. 1).

The said fixed panels (16) are longitudinal structures. One side of the said panels (16A) borders the upper part of the thereafter, casted concrete panel and the other side borders the lower part of the thereafter casted concrete panel (16B). The fixed panel (16) includes guides (15) along the length of the panel to receive the slideable panel (18). The said panel (16A) is provided with at least one aperture (24). The aperture (24) is provided to receive reinforcement bars.

Figure 2:
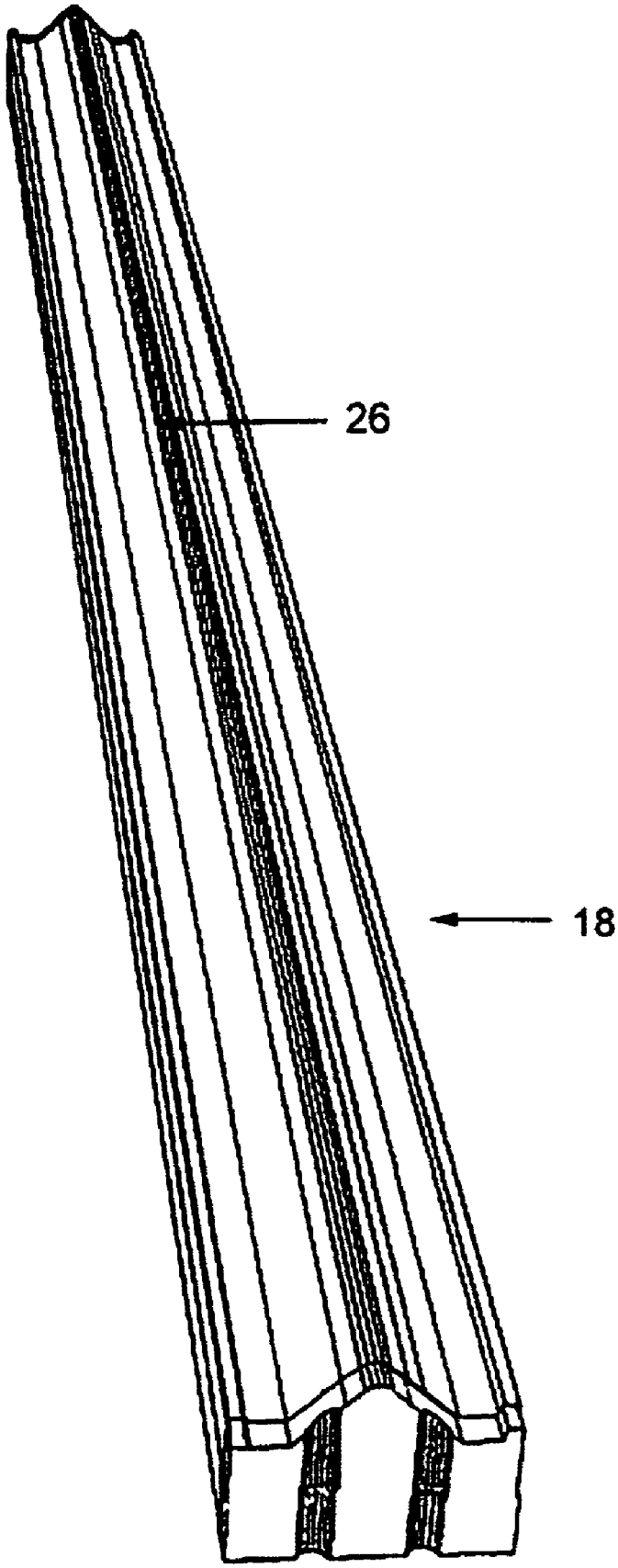
FIG. 2 is a perspective view of a parallel sideable spaced apart side panel.
Figure 3:
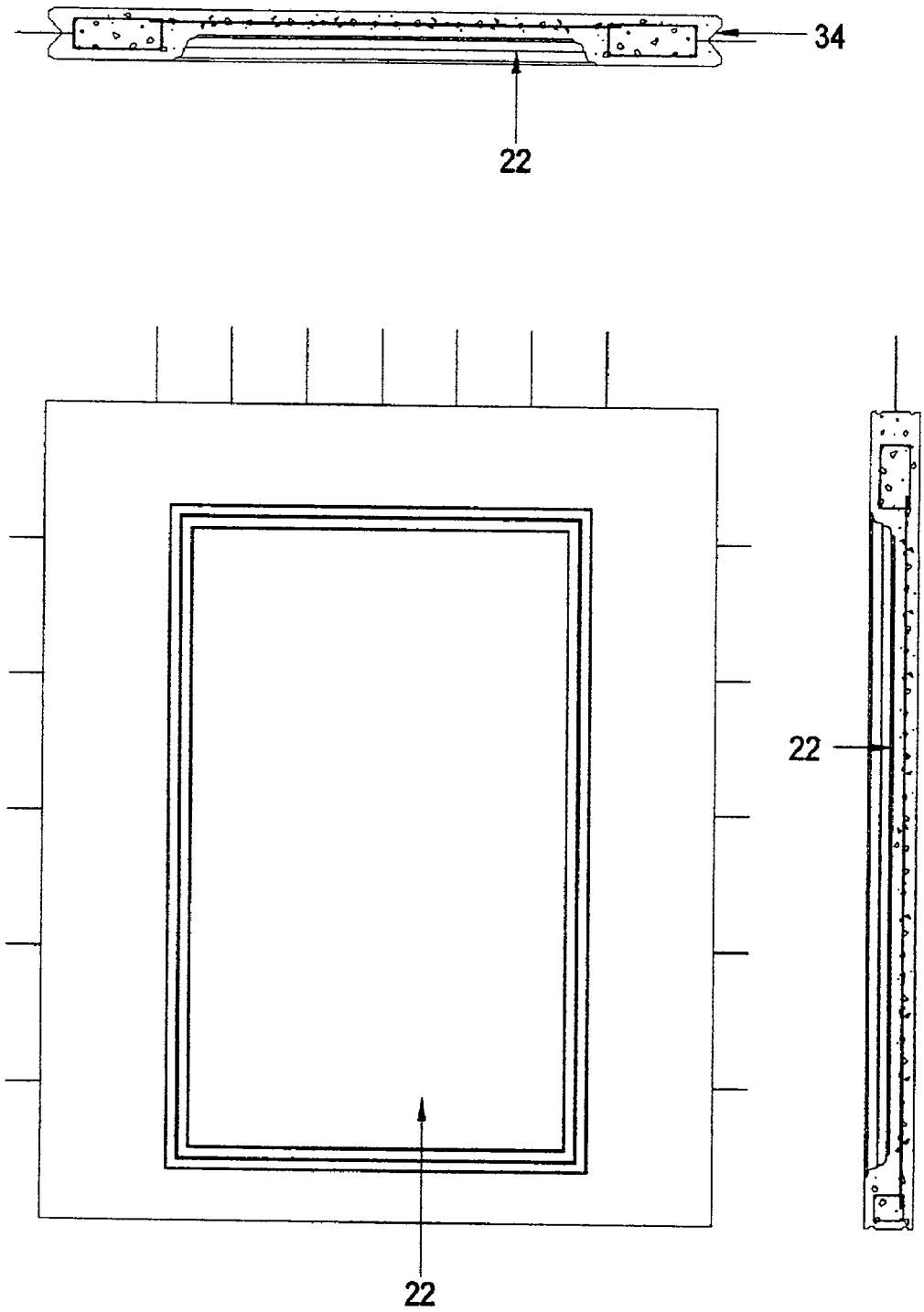
FIG. 3 is a plan view and, side and front cross sectional view of the completed precast concrete panel.

The said slideable panels (18) are also longitudinal structures and are positionalbe perpendicular to the fixed panels (16) along the same plane. At least one side of the each of the slideable panels (18) is provided with an longitudinal ledge (26), (FIG. 2). When the panels (16,18) are secured to the base (14) and concrete is poured therein, the longitudinal edge of the casted panel will include a longitudinal channel (34) corresponding to the said longitudinal ledge (26) when the concrete has set and then the parallel side panels (16,18) are removed from the base (14), (FIG. 3).

An island region (20) is defined wherein after casting, the precast concrete panel is provided with an opening. Said opening can be an opening for ventilation or can be for the purpose of installing a window or a door frame or the like. A mound region (22) is defined wherein after casting, the thickness of the precast concrete panel where the mound region is provided is smaller compared to the thickness of the other sections of the precast concrete panel. This configuration of the panel enable the structural strength of the panel to be maintained but the weight of the panel is substantially reduced without sacrificing the structural strength.

Figure 4:
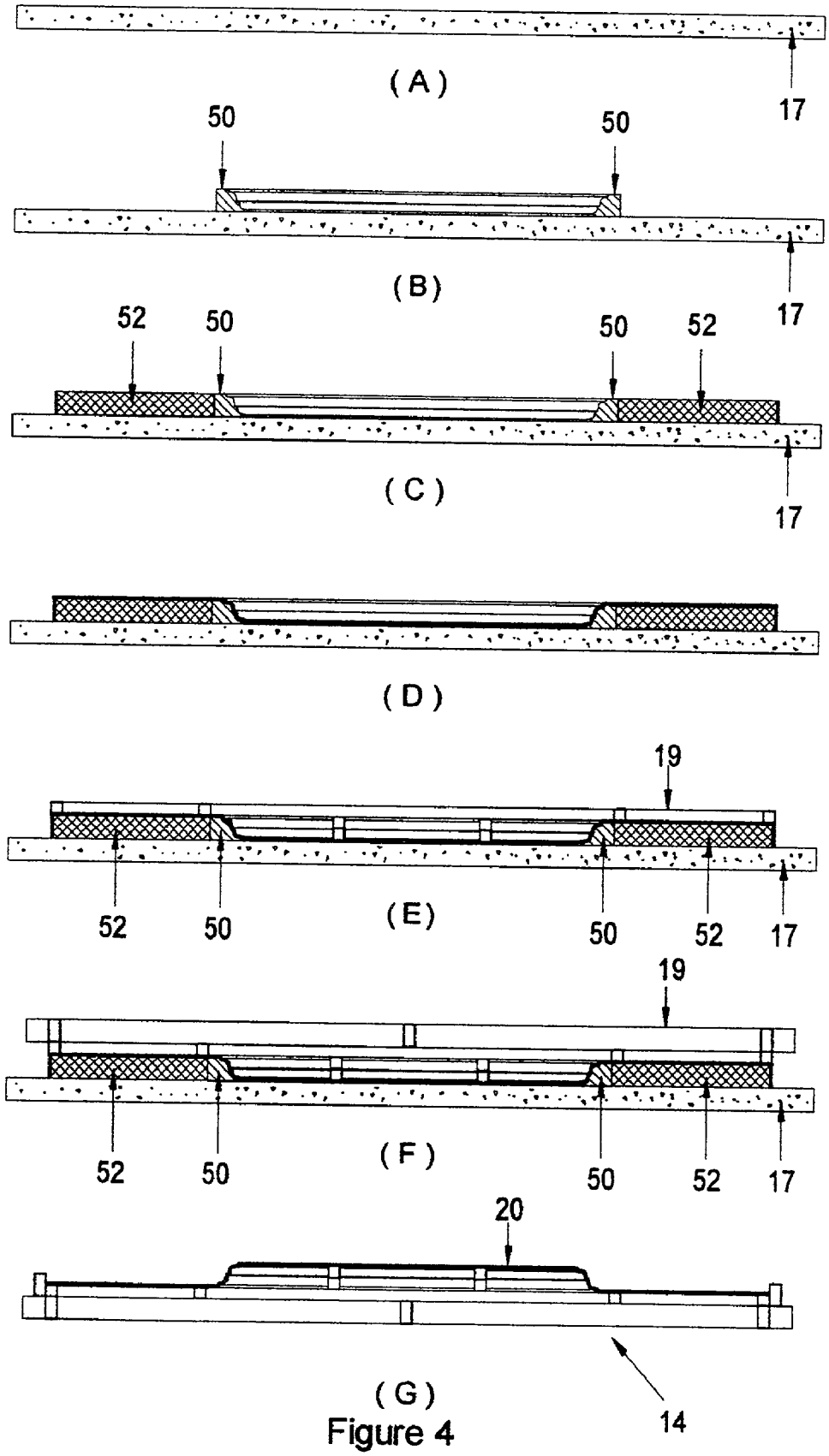
FIGS. 4A–4G shows the sequence of forming a base in cross sectional views.

Gypsum fame (50) is placed on a flat working platform (17) to form the rectangular enclosure, (FIGS. 4A & 4B). Borders (52) are placed along the peripheral edge of the gypsum frame (50), (FIG. 4C). Said borders (52) are made of gypsum or any other appropriate settable material. It will be appreciated that a depressed portion is created in the centre portion of the gypsum frame (50). Either fiberglass or plastics material is introduced into the enclosed portion and the borders (52) and left to set. (FIG. 4D). After the fiberglass material has set, a fiberglass mould is formed. It will be appreciated that a metal frame (19), which is laminated with fiberglass material is provided to the fiberglass mould before the gypsum frame (50) and the borders (52) are removed, (FIGS. 4E & 4F). The purpose of the said metal frame is to support the fiberglass mould when the said gypsum frame (50) and the borders (52) are removed, (FIG. 4G).

An imprint of a purposed window frame design is formed of gypsum material and is placed in the center of the enclosed portion constructed as mentioned above and thereafter fiberglass or plastics material is introduced. It will be appreciated that a metal frame, which is laminated with fiberglass material is provided to the fiberglass mould before the gypsum frame and the borders are removed. The purpose of the said metal frame is to support the fiberglass mould when the said gypsum frame and the borders are removed.

Figure 5:
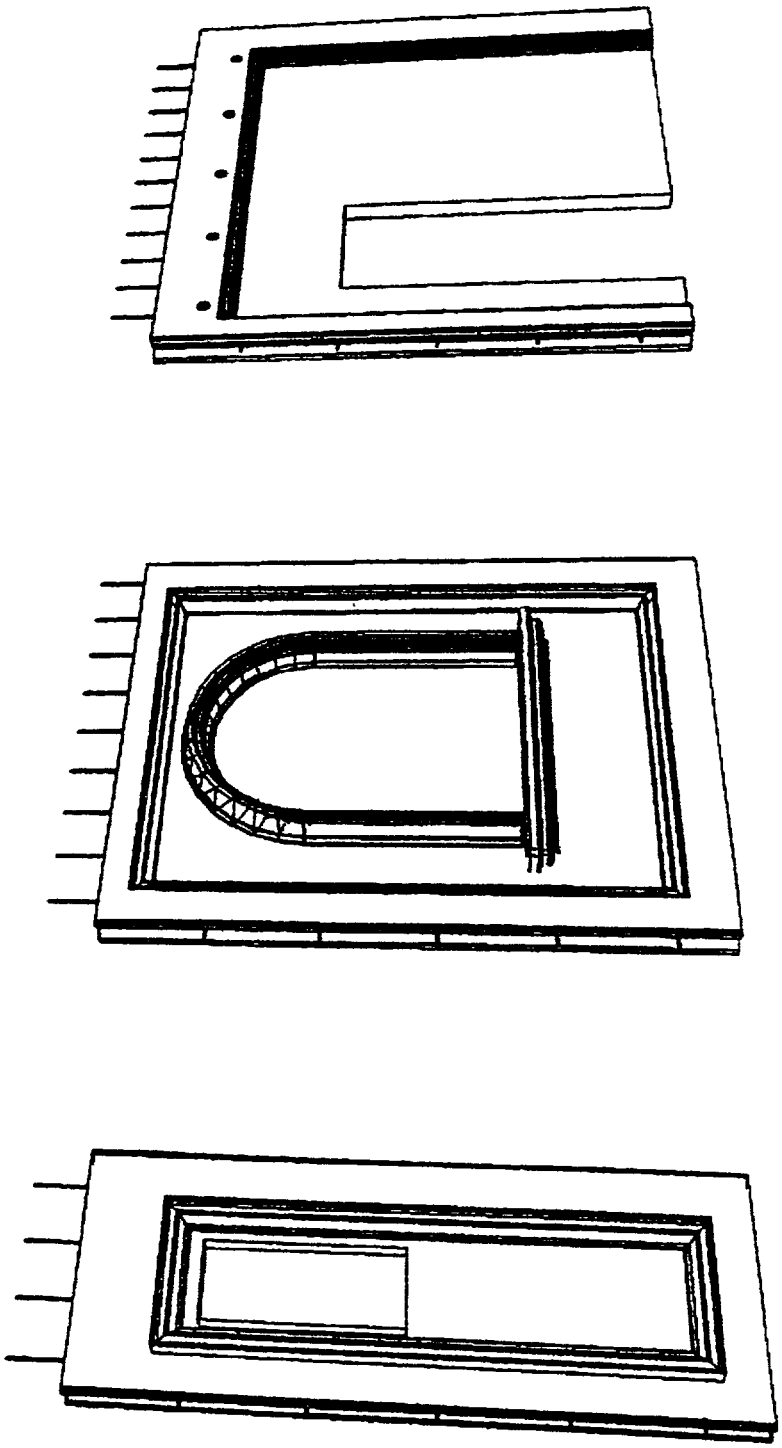
FIG. 5 shows various designs of precast concrete panels panel formed by a various type of moulds.
Figure 6:
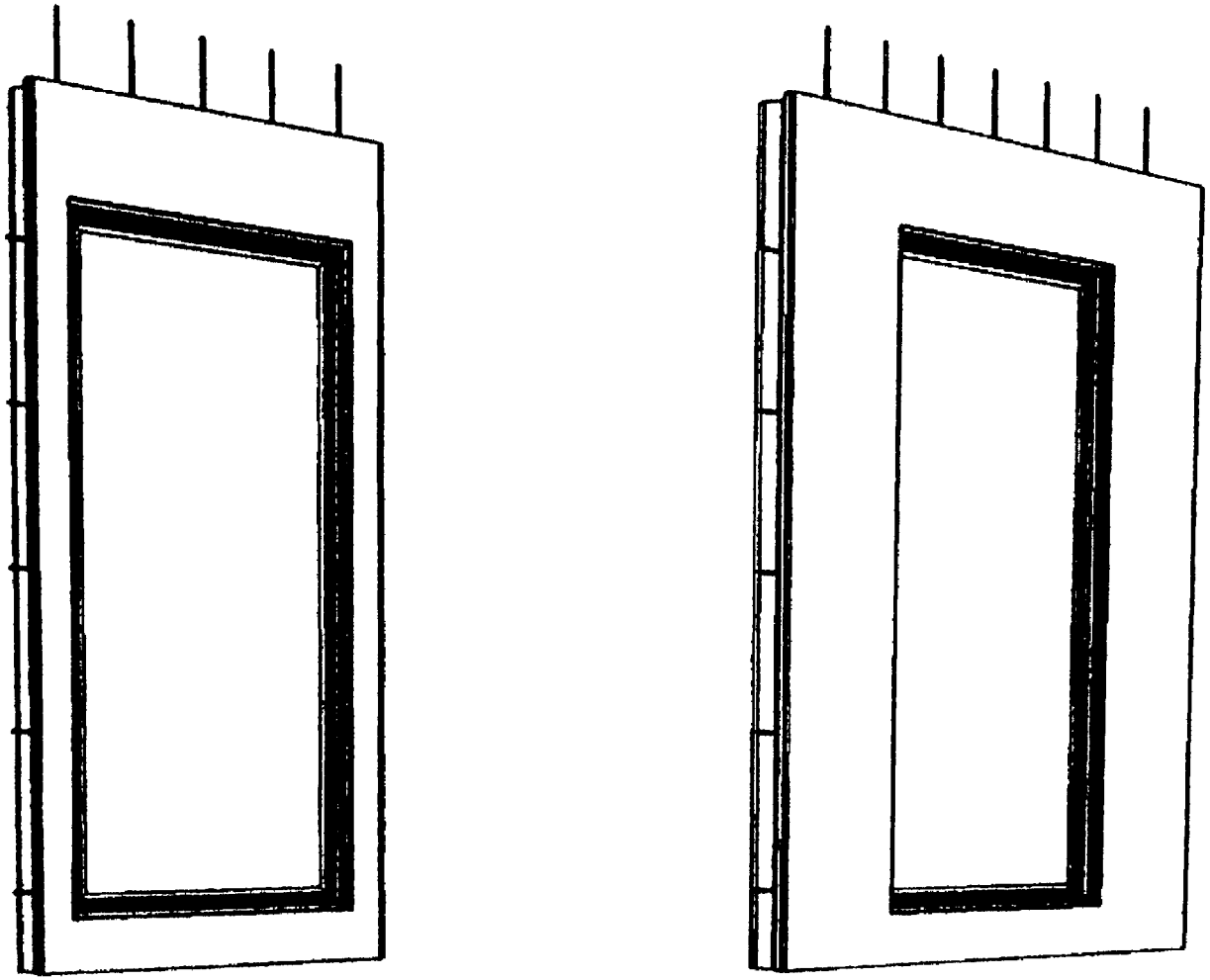
FIG. 6 shows various types of precast concrete panels with different widths formed by using the same mould.
Figure 6A:
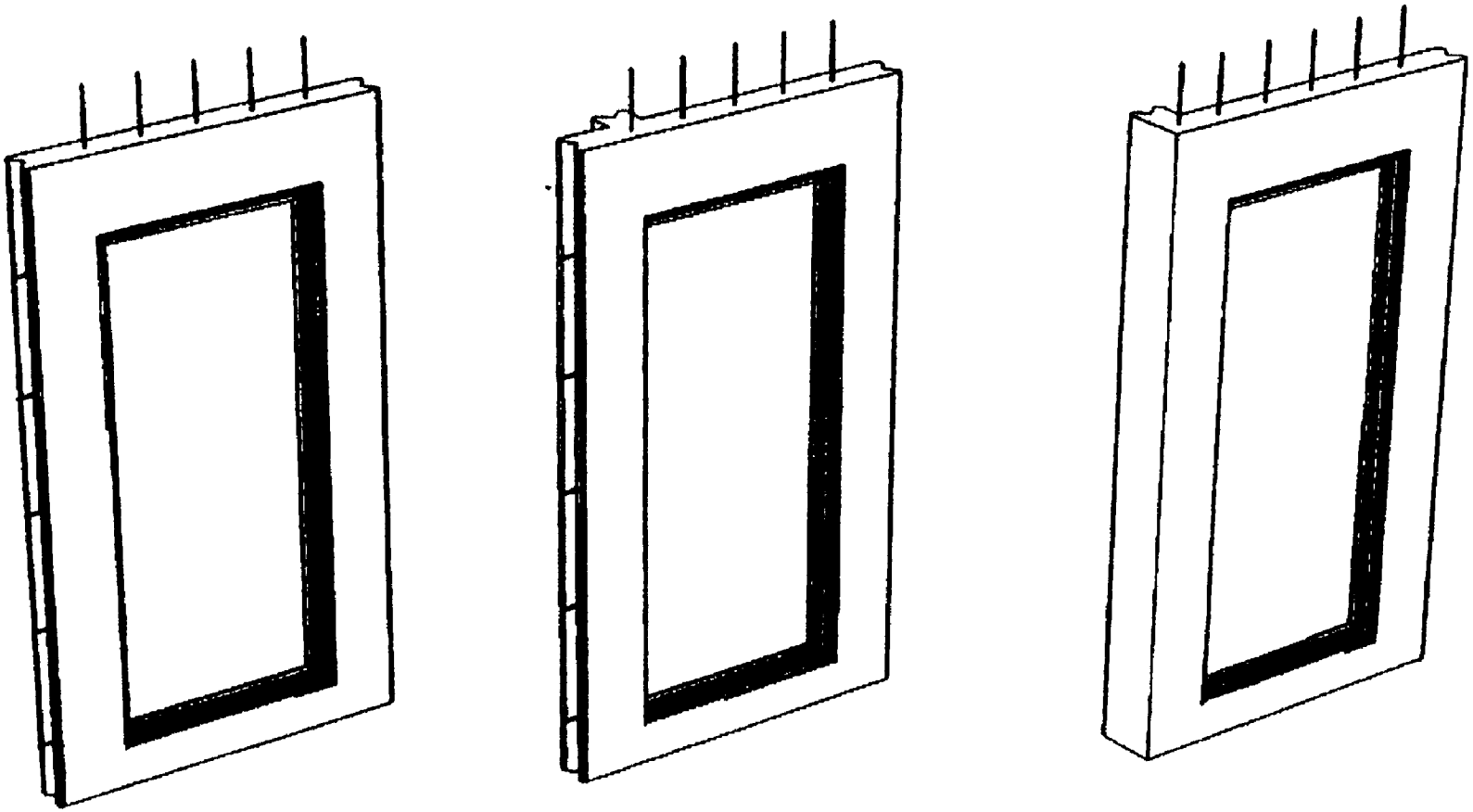
FIG. 6A shows precast concrete panels with and without the subsidiary 'T' and 'L' joints formed using the same mould.

It will be appreciated that a mould maker will be able to cast suitable mould for other desired design, (FIGS. 5, 6 & 6A).

In this embodiment the base (14) is formed as a single piece manually. It will be appreciated that for a large project, where large scale of identical mould is required, then the process of manufacturing said moulds can be done by utilizing the plastics moulding method.

Figure 7:
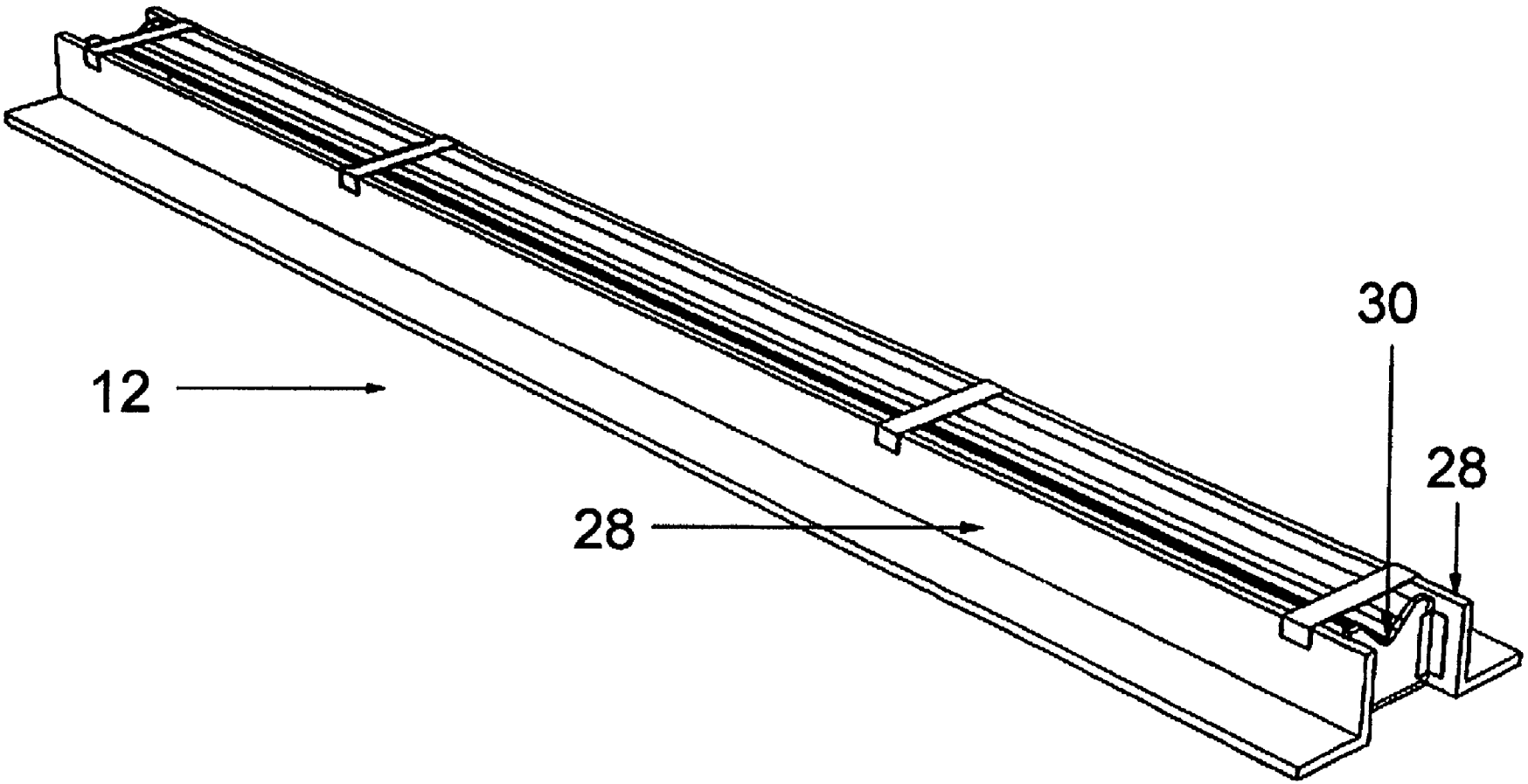
FIG. 7 shows a perspective view of the subsidiary formwork shown in FIG. 1.
Figure 8:
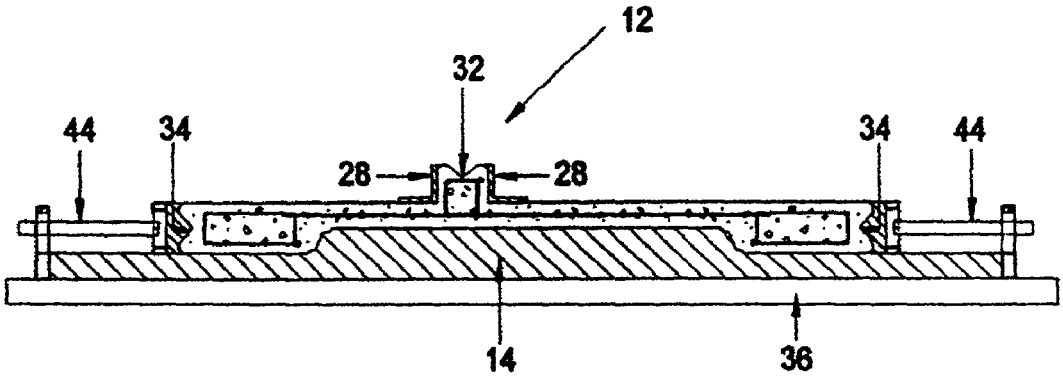
FIG. 8 shows a cross sectional view of the formwork with a subsidiary 'T' joint formwork.
Figure 9:
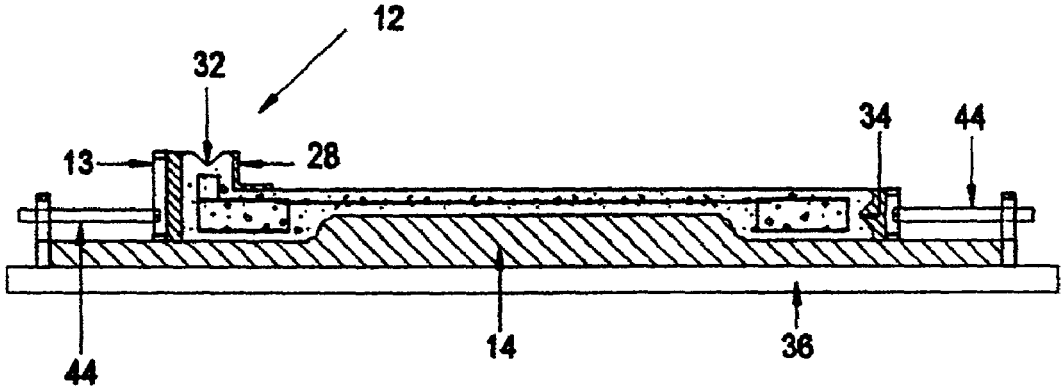
FIG. 9 shows a cross sectional view of the formwork with a subsidiary 'L' joint formwork.
Figure 10:
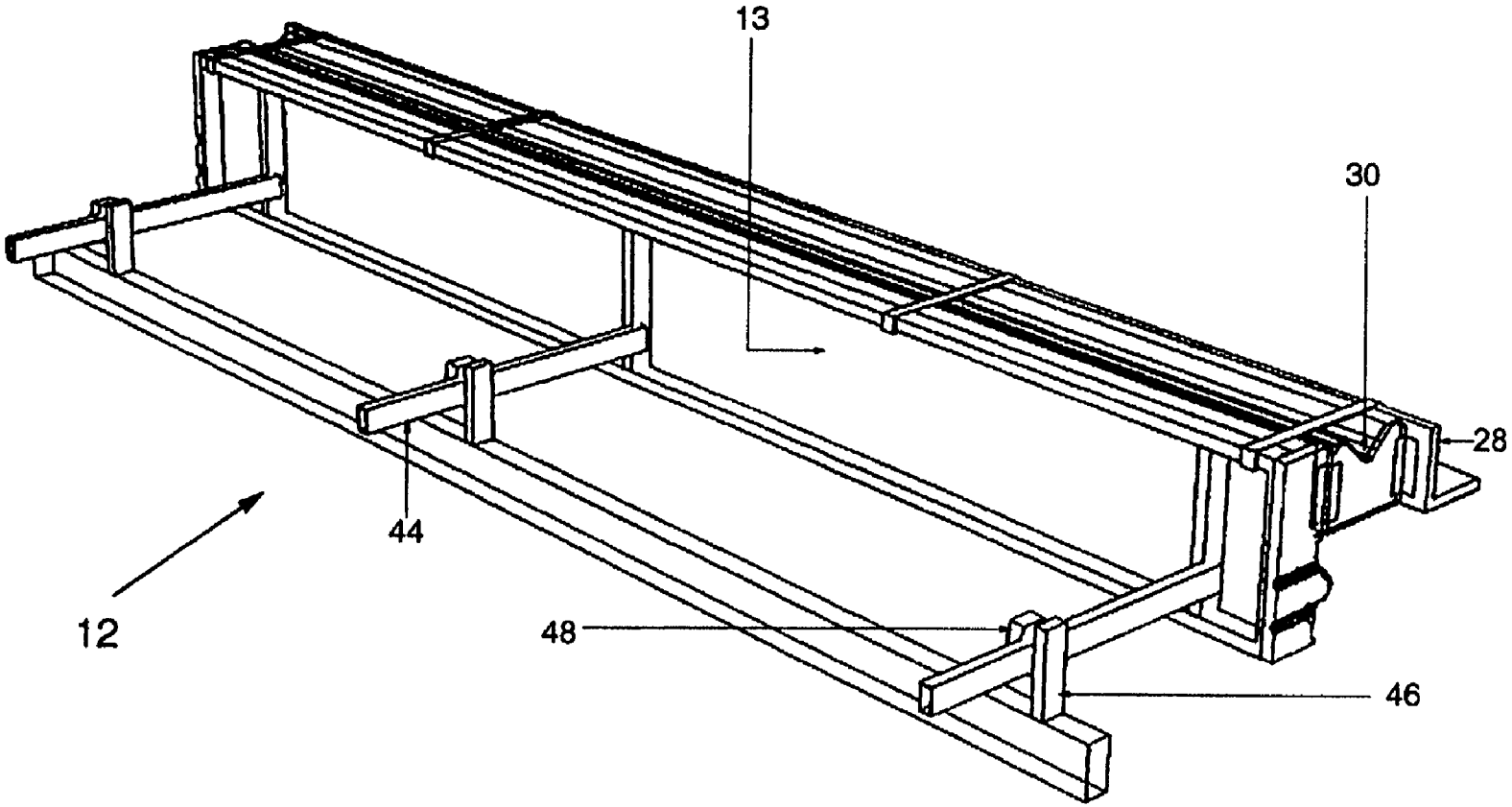
FIG. 10 shows a perspective view of the 'L' shaped subsidiary formwork of the present embodiment.
Figure 11:
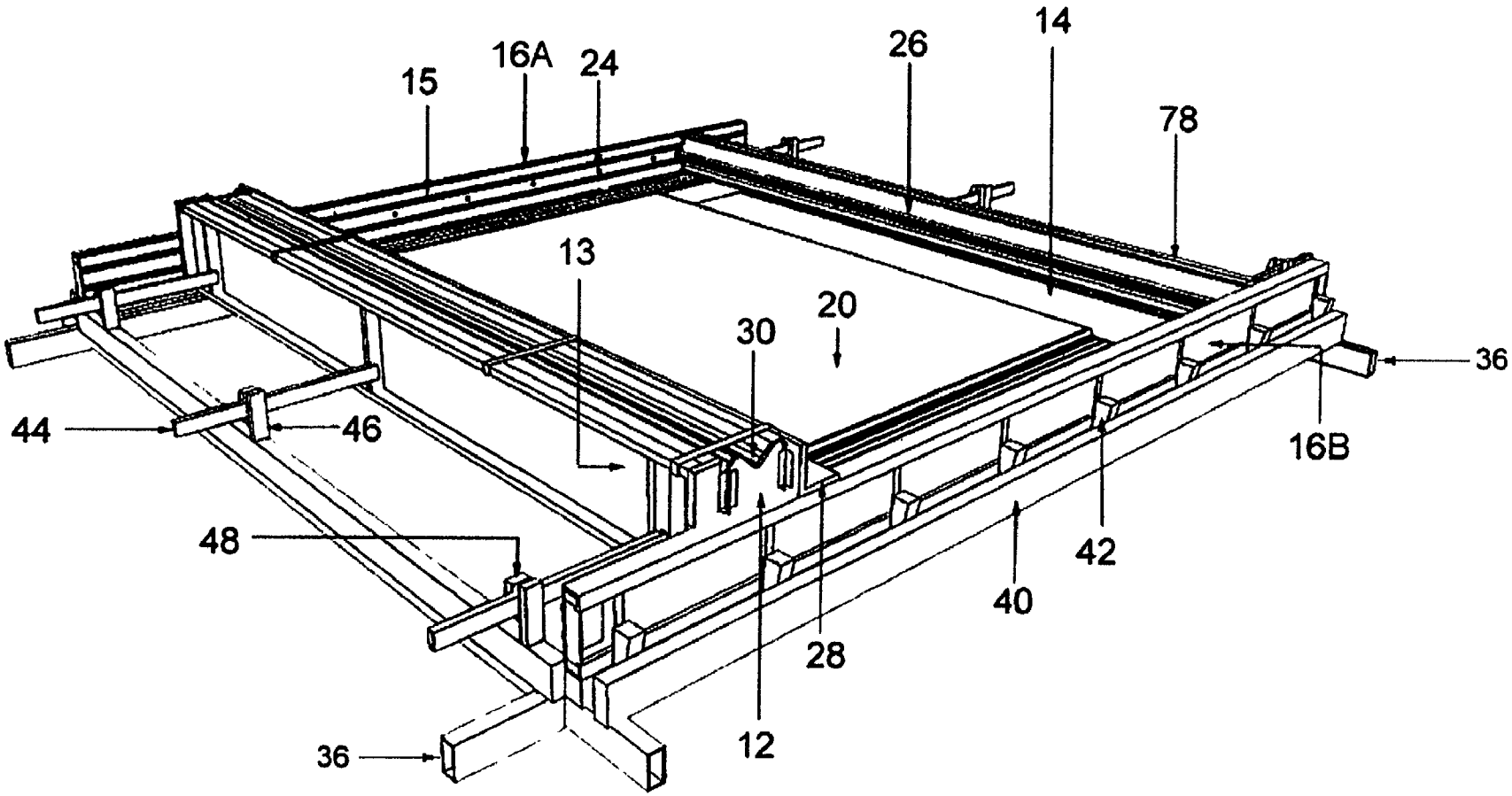
FIG. 11 shows a perspective view of the formwork provided with a 'L' shaped subsidiary formwork.

The subsidiary formwork (12) comprises of a pair of longitudinal parallel side panels (28). Said subsidiary formwork is provided on the casted main formwork for the purpose of providing an adjoining projecting structure such as a T-joint or a L-joint to receive other precast concrete panels. Said subsidiary formwork (12) is positionable at any point along the parallel fixed side panels (16). The subsidiary formwork (12) is provided on the main formwork either when the concrete poured in the main formwork has fully set or partly set. A longitudinal ledge (30) is accommodated within the pair of parallel side panels (28), wherein when the subsidiary formwork is casted and concrete material had set, the casted projecting structure would include a longitudinal channel (32) corresponding to the longitudinal ledge (30), (FIGS. 7 & 8). When a projecting structure is to be positioned at the terminal edge of the panel, the slideable panel (18) on the outside can be replaced by a panel (13), which is integrated with the slideable panel (18), (FIGS. 9 to 11).

Figure 12:
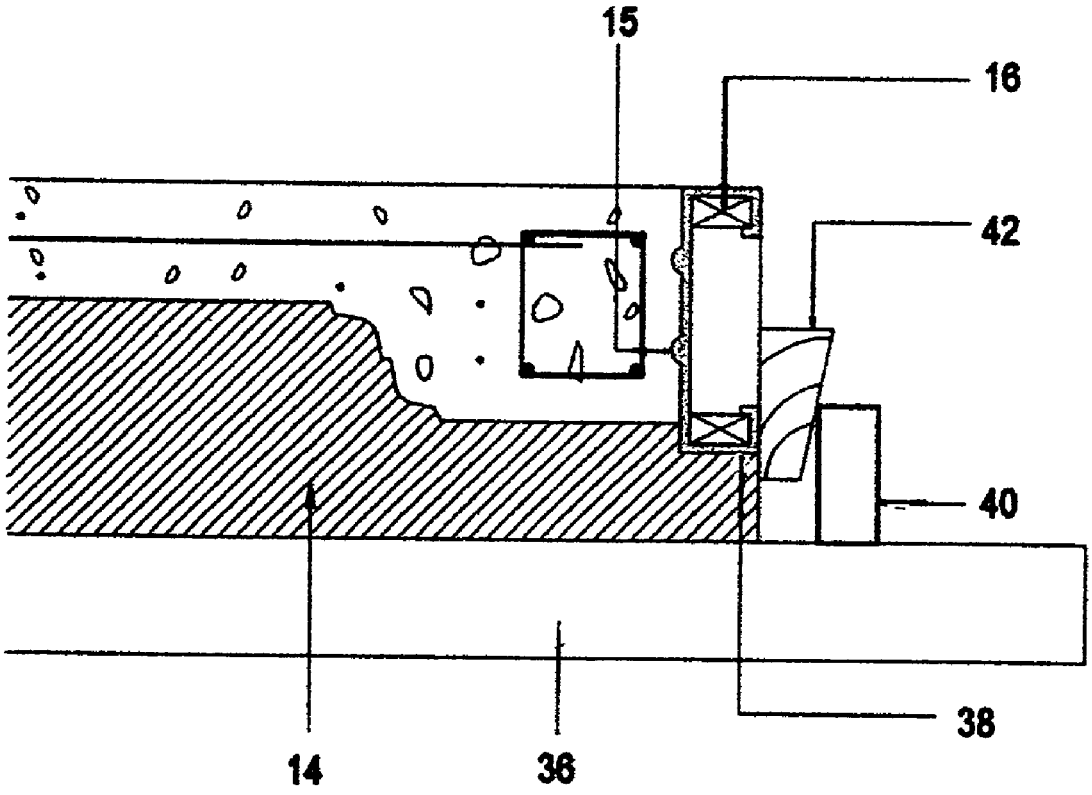
FIG. 12 shows a cross sectional view of the securing means of the parallel fixed space apart side panels to the base.

The working mechanism of the present invention and other features not described earlier will be described now. Firstly, the said base (14) is placed on a supporting structure (36), which is essentially a rigid planar surface, (FIGS. 8 & 9). The supporting structure is placed in a totally horizontal plane. Each of the fixed panels (16) is placed on a rebated portion (38) on the base (14), (FIG. 12). The width of the said rebated portion (38) is equivalent to the width of the fixed panels (16). A restricting means (40) is provided on the supporting structure (36) to secure the fixed panels (16) on the base (14) and also to secure the base (14) on the supporting structure (36). Said restricting means (40) is preferably a metal bar which is welded to the supporting structure (36), (FIG. 1). The said base (14) is placed on the supporting structure (36) in such a manner that, each terminal edge of the upper part and the lower part of the base (14) is provided with at least one restricting means (40). A gap is allocated between the edge of the base and the restricting means (40) to receive a wedged spacer means (42). Said wedged spacer means (42) is provided to ensure that the fixed panels (16) is secured on the rebated portion (38) of the base (14) and the base (14) is secured to the supporting structure (36).

Figure 13:
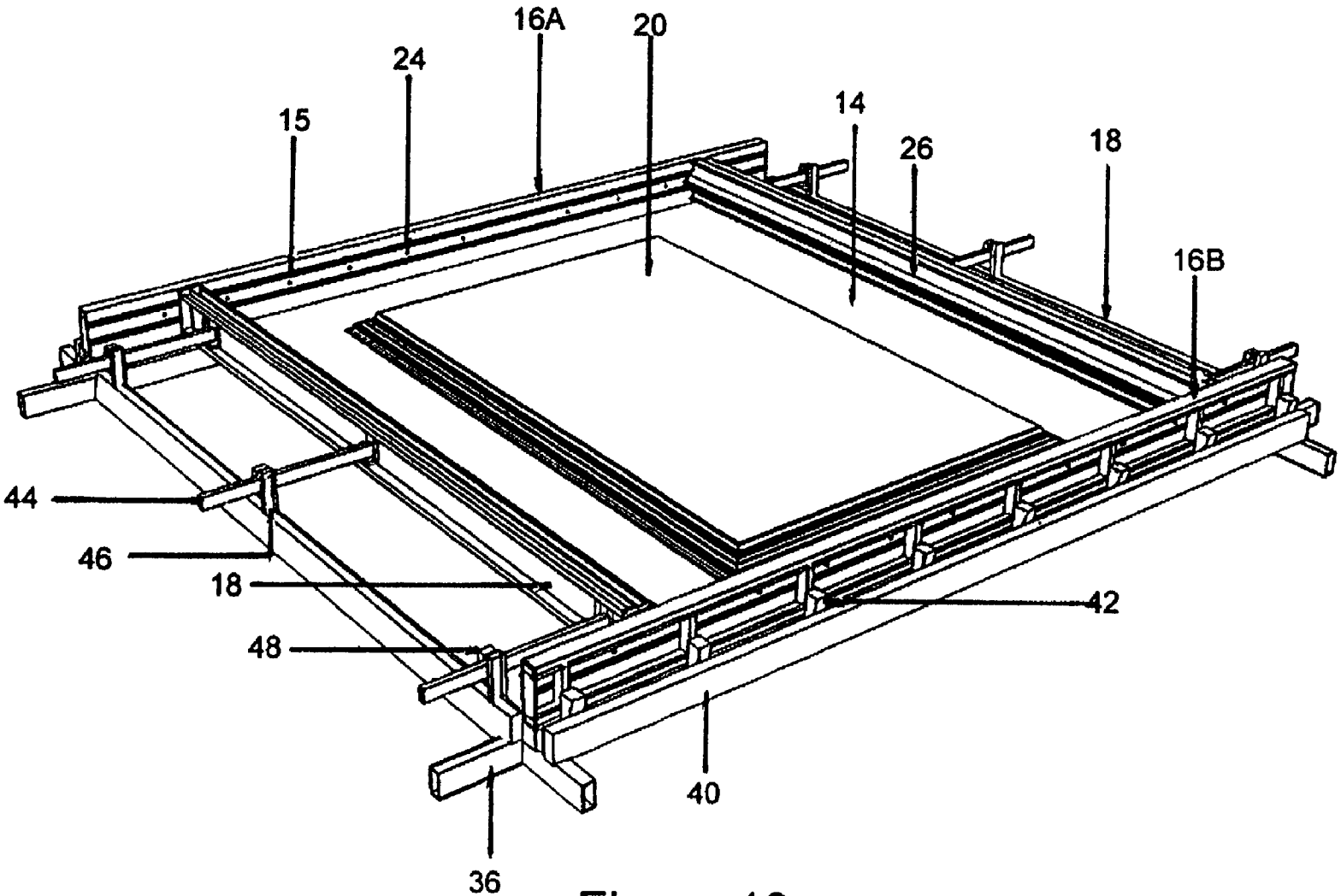
FIG. 13 shows a perspective view of the formwork shown in FIG. 1 without providing any subsidiary formwork.
Figure 14:
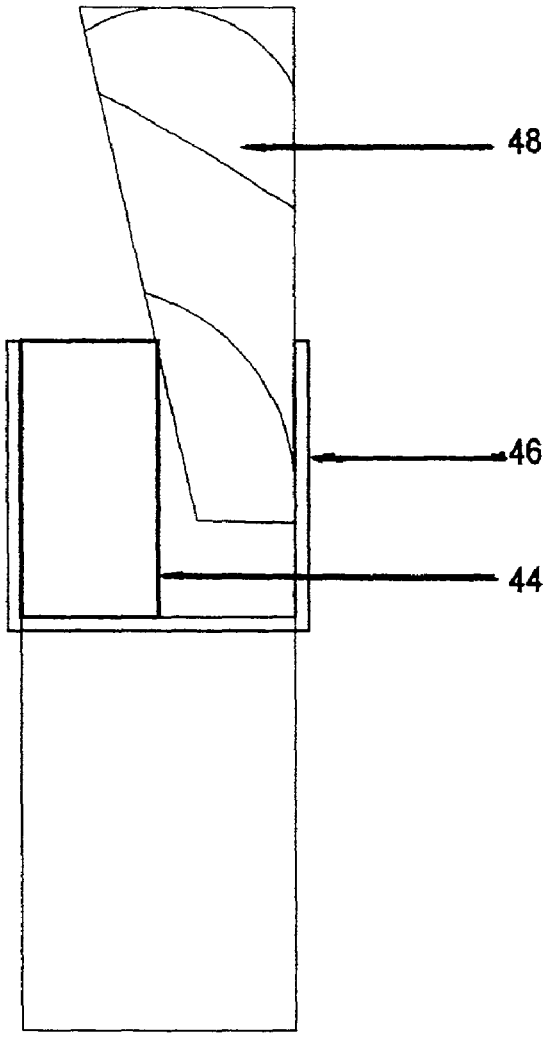
FIG. 14 shows a side view of the securing means of the parallel slideable spaced apart side panels as shown in FIG. 10.

Once the width of the precast concrete panel has been determined, the slideable panels (18) are slideably positioned apart from the central portion of the base (14) and between the fixed panel (16). When said determined width is confirmed, the said slideable panels (18) are locked in its present position. The means of locking the slideable panels (18) in its position is done by providing an adjustable arm (44) wherein one end of the adjustable arm (44) is placed against the slideable panels (18) while the other end extends and placed in a bracket (46), (FIG. 13). To secure the other end of the adjustable arm (44) in the bracket (46), a spacer (48) is introduced into the gap between the said end of the adjustable arm (44) and the bracket (46), (FIG. 14). Furthermore, the terminal edge of the slideable panels (18) is configured to matingly fit the contour on the fixed panels (16) in order to provide a rigid structure. This method ensures that the slideable panels (18) remains in an upright position when the concrete is poured into the formwork (10). This configuration enables easy and convenient dismantling of the side panels from the base (14).

When the said side panels (16,18) are securely mounted to the base (14), concrete is poured into the formwork. After the concrete has set, the parallel side panels (16,18) are removed and the casted concrete panel is stored while waiting to be transported to the construction site.

When concrete is poured in the formwork, it can be either poured by fully covering the island region (20) on the base (14) or by just covering the sides of the island region (20). When the concrete is poured in the formwork and is flushed with the height of the fixed panels (16), a recess is created on the thereafter casted precast concrete panel corresponding to the mound region in the mould. Whereas, when the concrete is poured in the formwork and is flushed with the upper side edges of the island region (20), an opening is created.

In the present embodiment, the island region (20) and the mound region (22) are designed as a flat planar surface, but said island region (20) and mound region (22) can be designed in any other geometrical shaped structure or can be provided with design wherein upon casting, it resembles an impression of an object such as a vase, an animal and the like, (not illustrated).

In the present embodiment, the island region (20) and/or the mound region (22) is positioned on the base (14) in such a manner that, said island region (20) and/or mound region (22) is centrally located between the slideable spaced apart side panel (18) or between both the fixed and slideable panels (16,18). Said island region (20) and/or mound region (22) can be positioned anywhere between the two pairs of parallel side panels (16,18) with or without additional adjustment or modifications.

In the present embodiment, the fixed panels (16) is secured to the base by providing a restraining member (38) and a wedged spacer timber (42), but said fixed panels (16) can be either secured to the base by providing a tongued member of the fixed panel (16) and a grooved member on the rebated portion of the base or by any other means known in the art, (not illustrated).

Figure 15:
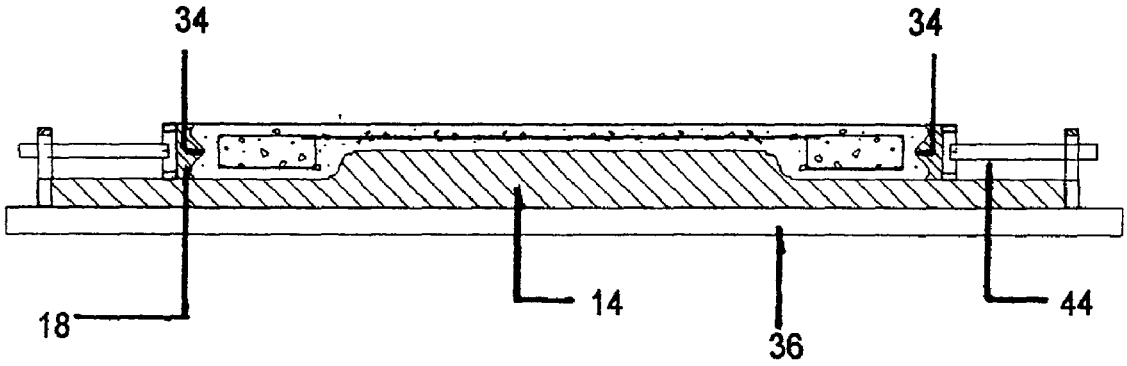
FIG. 15 shows a cross sectional view of the formwork shown in FIG. 13.

In the present embodiment, the completed precast concrete panel includes a projecting portion such as a 'T' joint or a 'L' joint for the purpose of providing an adjoining projecting structure to receive other precast concrete panels. However, said precast concrete panel can also be constructed without the projecting structures, (FIG. 15). Therefore, to secure precast concrete panels to each other, a separate 'T', 'L', crossed or even a rectangular shaped columns can be erected on site.

The invention claimed is:

1. A formwork for pre-cast concrete panels comprising:

a base which is provided with an island region for forming an opening in the concrete panels or a reduced thickness region compared to surrounding areas in the concrete panels;

a pair of parallel fixed spaced apart side panels attached to the base; and a pair of parallel moveable spaced apart side panels;

wherein said island region is positioned between the parallel moveable spaced apart side panels and wherein said parallel moveable spaced apart side panels are removably secured to the parallel fixed spaced apart side panels in a tight manner in a distance from the center of the island region, wherein a subsidiary formwork is assembled thereon to the formwork in which the subsidiary formwork comprises a pair of longitudinal spaced apart panels across the pair of parallel fixed spaced apart side panels wherein the inner sides of the longitudinal spaced apart panel form the sides of a mould and the upper surface of the concrete in the formwork forms the base of the mould, said mould is designed to receive concrete such that on setting, a projecting edge is formed, wherein in the subsidiary formwork, the distance apart between each member of the set of longitudinal spaced apart panel is variable such that the casted longitudinal edge is of a variable pre-determined width.

2. A formwork for pre-cast concrete panels comprising:

a base which is provided with at least one of an island region and a mound region;

a pair of parallel fixed spaced apart side panels; and a pair of parallel moveable spaced apart side panels;

wherein at least one of said island region and mound region is positioned between the parallel moveable spaced apart side panels and wherein said parallel moveable spaced apart side panels are removably secured to the parallel fixed spaced apart side panels in a tight manner in a distance from the center of at least one of the island and mound region;

wherein a subsidiary formwork is assembled thereon to the formwork in which the subsidiary formwork comprises a pair of longitudinal spaced apart panels across the pair of parallel fixed spaced apart side panels wherein the inner sides of the longitudinal spaced apart panel form the sides of a mould and the upper surface of the concrete in the formwork forms the base of the mould, said mould is designed to receive concrete such that on setting, a projecting edge is formed, wherein in the subsidiary formwork, the distance apart between each member of the set of longitudinal spaced apart panel is variable such that the casted projecting edge is of a variable pre-determined width.

* * * * *